United States Patent [19]

Bernard

[11] 4,359,313

[45] Nov. 16, 1982

[54] LIQUID RING PUMP SEAL LIQUID CHILLER SYSTEM

[75] Inventor: Paul V. Bernard, Shelton, Conn.

[73] Assignee: The Nash Engineering Company, Norwalk, Conn.

[21] Appl. No.: 129,270

[22] Filed: Mar. 10, 1980

[51] Int. Cl.[3] ..... F04C 19/00

[52] U.S. Cl. ..... 417/68; 165/101

[58] Field of Search ..... 417/13, 32, 68, 69, 417/313, 292; 165/101, 103, 34, 35

[56] References Cited

U.S. PATENT DOCUMENTS

| | | | |
|---|---|---|---|
| 1,346,898 | 7/1920 | Kingsbury | 137/412 X |
| 1,991,548 | 2/1935 | De Motte | 417/68 |
| 3,248,233 | 4/1966 | Brent et al. | 417/68 |
| 3,315,879 | 4/1967 | Jennings | 417/69 X |
| 3,875,995 | 4/1975 | Mannion et al. | 165/40 X |
| 4,071,082 | 1/1978 | Economides | 165/101 |
| 4,087,208 | 5/1978 | Uda et al. | 417/68 X |

*Primary Examiner*—Carlton R. Croyle
*Assistant Examiner*—Edward Look
*Attorney, Agent, or Firm*—Robert R. Jackson; John A. Howson

[57] ABSTRACT

In a system for evacuating fluids having vapor and gaseous phases, including a liquid ring pump, the seal liquid for which is provided in a closed system and is cooled by a heat exchanger through cooling liquid fed to the heat exhanger from outside the system, means are provided for diverting the seal liquid through a chiller when the temperature of the cooling liquid approaches the temperature of the gas/liquid mixture entering the pump. The chiller maintains the seal liquid temperature below the temperature of the cooling liquid in the heat exchanger and the cooling liquid is used in the chiller to receive the heat rejected from the seal liquid.

4 Claims, 1 Drawing Figure

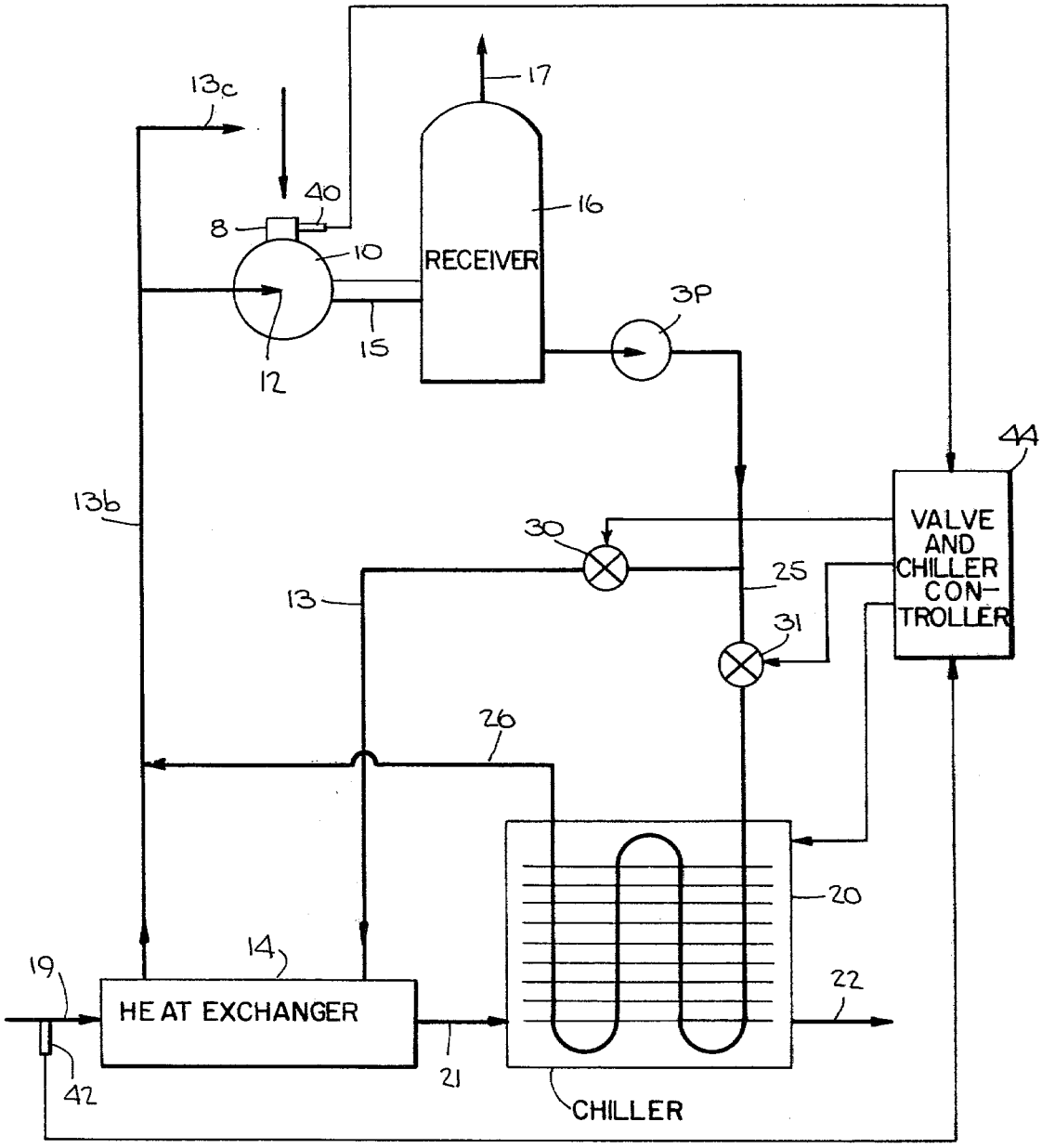
13c
17
40
16
8
10
RECEIVER
3P
15
12
44
13b
30
VALVE AND CHILLER CON-TROLLER
25
13
31
26
20
14
19
HEAT EXCHANGER
22
21
42
CHILLER

LIQUID RING PUMP SEAL LIQUID CHILLER SYSTEM

BACKGROUND OF THE INVENTION

Systems for evacuating fluids having gaseous and vapor phases from large condensers of turbine-driven power plants, for instance, frequently use cooling liquid, such as water, from the same source as does the system being evacuated. In such systems, the temperature of the gas/vapor evacuated from the condenser may approach the temperature of the cooling liquid in the evacuating system. This may occur, for example, when the condenser operates at low load.

When the vapor and gases are compressed in a liquid ring pump in such an evacuating system, the heat of compression and condensation is transferred to the liquid in the pump which, within a closed system, is circulated from the pump through a cooler or heat exchanger back to the pump as seal liquid for the pump. The cooler in the system thus-far described has the capability of cooling the liquid in the evacuating system to below the temperature of the gas/vapor mixture as it enters the pump. However, if the cooling liquid for the heat exchanger of the evacuating system, drawn from the same source as the cooling liquid for the evacuated system, approaches too close to the temperature of the gas and vapor mixture from the evacuated system, saturation of the vapor with liquid from the seal will diminish the capacity of the pump.

A concomitant problem arises in the prior art attempt to cool the seal liquid of the pump using only a heat exchanger with cooling liquid. That problem is excessive cooling liquid consumption.

SUMMARY OF THE INVENTION

The present invention provides a chiller (e.g., a mechanical cooler of the refrigerant evaporative type) to which the seal liquid in the evacuating system is delivered when the cooling liquid temperature approaches the saturation temperature of the inlet gases; or when the inlet gas/vapor temperature approaches the temperature of the cooling liquid. The chiller maintains the seal liquid temperature below the cooling liquid temperature and rejects its heat to the cooling liquid which is led through the chiller from the heat exchanger of the evacuation system.

As will be appreciated, the chiller may be activated manually or automatically and may be valved in and out of the seal liquid system.

BRIEF DESCRIPTION OF THE DRAWING

FIG. 1 is a schematic flow diagram of the evacuating system of the invention.

DETAILED DESCRIPTION OF THE INVENTION

Processed gas/vapor such as air and water is delivered to liquid ring pump 10 via pump inlet 8 from the system to be evacuated (e.g., the condenser of a turbine-driven power plant). The evacuation system including pump 10 may be similar to that disclosed in U.S. Pat. No. 3,315,879. Pump 10 has seal liquid (e.g., water) supplied to it at 12 by conduit 13 via heat exchanger 14. Compressed gas/vapor, condensed process vapor, and expended or excess seal liquid exit from pump 10 via discharge side 15 communicating with receiver 16. Receiver 16 in the present embodiment is an air receiver communicating with the atmosphere via conduit 17. It will be understood that the evacuation system of this invention may be used in connection with any type of gas other than air.

Receiver 16 receives the discharge of pump 10 and separates it into its liquid and gaseous phases by permitting the gas to flow out to the atmosphere via conduit 17 at the top of receiver 16 while the liquid (primarily seal liquid) collects at the bottom of the receiver. The seal liquid is pumped out of receiver 16 by pump 3P and is delivered via conduit 13 to heat exchanger 14. In heat exchanger 14 the seal liquid is cooled by heat exchange with cooling liquid (typically water) supplied from outside the system via conduit 19. The cooled seal liquid is then circulated back to pump 10 via extensions **13*b* and 13*c* of conduit 13. As will be apparent to those skilled in the art, conduit 13*c* may deliver part of the liquid to a condenser (not shown, but similar to condenser 20 in FIG. 1 of U.S. Pat. No. 3,315,879) from whence the liquid is eventually returned to pump 10**.

In accordance with the invention, chiller 20 is provided to which cooling liquid from heat exchanger 14 is delivered via conduit 21 and through which the cooling liquid circulates to be discharged at 22. Chiller 20 is also connected to the seal liquid circuit of the evacuating system via inlet 25 which is connected to conduit 13 upstream of heat exchanger 14, and via outlet 26 which communicates with seal liquid delivery conduit **13*b* downstream of heat exchanger 14. Chiller 20 may be any of several conventional types of chillers. For example, chiller 20** may be a conventional mechanical shell-and-tube cooler of the refrigerant evaporative type and in which the cooling liquid from the heat exchanger is readily used as a secondary cooling medium.

Valve 30 is provided in conduit 13 for shutting off the circulation of the seal liquid through that conduit and for delivery of the seal liquid through conduit 25 to chiller 20. Valve 31 acts to open the chiller to accept delivery of seal liquid from pump 3P. Valves 30 and 31 may be manually operated or they may be automatically controlled in response to temperatures at appropriate points in the evacuating system. Chiller 20 may be started and stopped in the same manner that valves 30 and 31 are controlled. In the embodiment shown in FIG. 1, for example, temperature sensors 40 and 42 respectively monitor the temperatures of the gas/vapor in inlet conduit 8 and the cooling liquid temperature in conduit 19 and produce corresponding electrical output signals applied to valve and chiller controller 44. Controller 44 compares the output signals of sensors 40 and 42 and produces output signals for opening valve 30, closing valve 31, and stopping chiller 20 when the temperature detected by sensor 40 is at least a predetermined amount greater than the temperature detected by sensor 42. Conversely, when the temperature detected by sensor 40 is not at least the predetermined amount greater than the temperature detected by sensor 42, controller 44 produces output signals for closing valve 30, opening valve 31, and starting chiller 20.

In operation, when the cooling liquid of heat exchanger 14 approaches the saturation temperature of the incoming gas/vapor in conduit 8 from the system to be evacuated, chiller 20 is started and valves 30 and 31 are operated to divert the seal liquid from circulating through heat exchanger 14 to circulate through chiller 20. Chiller 20 is designed to maintain the seal liquid temperature below the cooling liquid temperature and reject its heat to the cooling liquid. As a result, the evacuation system functions more efficiently and without the requirement for excessive cooling liquid consumption.

I claim:

1. In a system for evacuating fluid having liquid and gaseous phases and including a liquid ring pump connected to the source of fluid, a first conduit for conveying seal liquid discharged from the pump, a heat exchanger normally connected to the first conduit for normally cooling the seal liquid in the first conduit by heat exchange with a cooling liquid, and a second conduit for normally conveying the cooled seal liquid from the heat exchanger to the pump for reuse as seal liquid in the pump, the improvement comprising:

a chiller for cooling the seal liquid discharged from the pump to a temperature below the temperature to which it can be cooled by the heat exchanger;

first means disposed in the first conduit for selectively stopping the flow of seal liquid from the pump to the heat exchanger;

a third conduit connected to the first conduit upstream of the first means for selectively conveying seal liquid from the first conduit to the chiller, the third conduit including second means for selectively stopping the flow of seal liquid from the first conduit to the chiller;

a fourth conduit for conveying seal liquid from the chiller to the second conduit;

third means for sensing the temperature of the cooling liquid supplied to the heat exchanger; and means responsive to the third means for controlling the first and second means to stop the flow of seal liquid from the pump to the heat exchanger and to allow the flow of seal liquid from the first conduit by way of the third conduit to the chiller when the temperature of the cooling liquid is above a threshold temperature established as a function of the temperature of the fluid being evacuated, and to allow the flow of seal liquid from the pump to the heat exchanger and to stop the flow of seal liquid from the first conduit by way of the third conduit to the chiller when the temperature of the cooling liquid is below said threshold temperature.

2. The apparatus defined in claim 1 wherein the means responsive to the third means comprises:

fourth means for sensing the temperature of the fluid being evacuated; and means responsive to the fourth means for establishing the threshold temperature in predetermined relation to the temperature of the fluid being evacuated.

3. The apparatus defined in claim 2 wherein the chiller is a mechanical cooler and wherein the means for controlling the first and second means further comprises means for operating the chiller only while the seal liquid is flowing to the chiller.

4. The apparatus defined in claim 3 further comprising a fifth conduit for conveying the cooling liquid from the heat exchanger to the chiller for receiving heat rejected from the seal liquid by the chiller.

* * * * *